United States Patent [19]

Kristen et al.

[11] 4,125,357

[45] Nov. 14, 1978

[54] CONTROL AND MONITORING SYSTEM FOR GAS BURNERS

[75] Inventors: Klaus Kristen, Wiesbaden; Herwig Scheidler, Finthen, both of Germany

[73] Assignee: Jenaer Glaswerk Schott & Gen., Germany

[21] Appl. No.: 815,507

[22] Filed: Jul. 14, 1977

[30] Foreign Application Priority Data

Jan. 3, 1977 [DE] Fed. Rep. of Germany ..... 2700025

[51] Int. Cl.[2] ..... F23N 5/00

[52] U.S. Cl. ..... 431/78; 126/39 J

[58] Field of Search ..... 431/75, 76, 77, 78; 126/39 J

[56] References Cited

U.S. PATENT DOCUMENTS

| | | | |
|---|---|---|---|
| 3,773,027 | 11/1973 | Dodd | 126/39 J |
| 3,820,938 | 6/1974 | Delf et al. | 431/78 |
| 3,986,814 | 10/1976 | Demée | 431/80 |

*Primary Examiner*—Edward G. Favors

*Attorney, Agent, or Firm*—Hill, Gross, Simpson, Van Santen, Steadman, Chiara & Simpson

[57] ABSTRACT

An electronic control system monitors, in a gas burner, the four functions of (1) initial ignition of the gas, (2) continued combustion of the gas, (3) the average time rate at which the gas is burned, and (4) the maximum temperature of the combustion chamber. A first comparator is responsive to a first thermosensitive element for controlling the average burning rate (or energy output) and the maximum temperature limit; a second comparator is responsive to a second thermosensitive unit for monitoring the flame of the burner, to sense initial and continued ignition; a third comparator functions as a timedelay circuit in association with the second comparator during an initial ignition procedure; and a fourth comparator controls the source of gas in response to the condition of the first and second comparators, so that gas is supplied only when both safe and necessary.

16 Claims, 6 Drawing Figures

CONTROL AND MONITORING SYSTEM FOR GAS BURNERS

BACKGROUND

1. Field of the Invention

The present invention relates to a system for controlling and monitoring a gas burner, and particularly to such a burner which is used for heating glass-ceramic cooking surfaces.

2. The Prior Art

Gas burners and radiant gas burners for heating glass-ceramic cooking surfaces typically have a closed burner space with an exhaust gas channel. The flame has a fixed adjustment, so that the heat energy supplied by the burner per unit period of time is constant. The time average heat output of the burner is controlled by a time-pulsed basis, so that the average rate of heat energy produced in any period of time is the integral of the pulses over that time. Ignition of the gas flame and extinguishing thereof are controlled automatically, with the aid of thermostats or the like. An ignition safety device monitors the burner flame, in order to shut off the gas supply when the flame is extinguished. It also blocks the gas supply if the gas fails to ignite from an ignition spark, or when the ignition spark is defective.

Glass-ceramic cooking surfaces of the type referred to, which are heated with radiant gas burners, pose particular problems with respect to the control of the gas in response to various parameters. For example, the average rate of energy, and burner temperature must be regulated in dependence on the thermal load of the cooking surface, which varies with different sizes of pots, and with pots having different heat conductivities and heat absorption characteristics. It is essential that overheating of the underside of the cooking surface be avoided by recognizing a tendency toward an overheated condition in time to avoid it by controlling a temperature-limiting device.

In the general field of gas burners, ignition safety devices, and devices for effecting a maximum temperature limitation, typically take the form of separate devices for each separate task. In addition, yet another separate device is generally employed for regulating the average energy output of the unit. Some ignition safety anf flame monitoring devices employ photoelectric cells are ionization sensors for checking the flame. Other devices operate with a bi-metallic element which operates in conjunction with a pilot flame. In still other cases, gas valves may be directly driven by thermosensitive elements. Typically, the maximum temperature control function is performed by rod expansion switches or by bi-metal switches. The average energy output of the burner is typically controlled by bi-metal switches or use liquid expansion switches or gas expansion switches, and with apparatus for operating the burner on a time-pulsed basis, independently of the burning chamber temperature.

When the conventional sensing elements are employed with burning chambers of radiant gas burners, the installation of such elements causes great difficulties because of the relatively small space available within the burning chambers. Bi-metallic thermosensitive elements cannot be used for energy control or for limiting the maximum temperature of radiant gas burners, because the temperature of the burning chamber, which is approximately 900° C., is too high for such elements.

Moreover, the use of rod expansion-type switches for controlling the maximum temperature is unsatisfactory, since the rod expansion switch can react only to the average temperature of the burning chamber, and cannot respond to localized overheatings of the glass-ceramic cooking surface. Accordingly, when rod expansion switches are used, the maximum temperature of the burning chamber must be limited to a relatively low temperature level, and the burner cannot be used to its full capabilities without danger of localized overheating.

Also, control of the average energy output of a burner by means of liquid expansion or gas expansion switches can be performed only indirectly, since these devices are limited to operating temperatures of below 300° C. An indirectly operable liquid expansion switch is disclosed in German Patent Application P 26 21 801.9, which employs a heat accumulation chamber which is separate from the burning chamber, but which is connected thereto. A disadvantage of this kind of control is the fact that the provision of the accumulation chamber causes a reduction in the effective size of the burner, so the heat output of the burner is reduced. Other disadvantages of indirect liquid expansion switches relate to the thermal inertia of the accumulation chamber, and the criticality of the adjustment of physical parts of such devices. The same is true for the gas expansion-type sensors. Other types of known energy control devices, and ignition safety devices, are also accommodated only with difficulty in the small burning chamber. Also, the devices used heretofore typically require a relatively large amount of external wiring, which it is desirable to avoid.

BRIEF SUMMARY OF THE INVENTION

It is a principal object of the present invention to provide a monitoring and control system for radiant gas burners which has a relatively simple electronic system with easily manageable sensing elements, and which requires relatively little space within the burning chamber and minimizes the amount of external wiring which is required.

It is another object of the present invention to provide such a system which undertakes the functions of ignition, ignition safety, energy control, and maximum temperature limitations, and responds effectively to localized hot spots in the heated cooking surface.

Another object of the present invention is to provide such a system which has specially constructed sensing elements which are arranged in a suitable manner in a burner space for carrying out the control functions.

In accordance with one embodiment of the present invention, there is provided an electronic circuit having four comparators which are linked to each other in a suitable manner and which are controlled by at least two thermosensitive elements. In a preferred embodiment, three thermosensitive elements are used to control the maximum temperature and to control the average energy output, while a fourth thermosensitive element monitors the initial ignition and continued combustion of the flame.

BRIEF DESCRIPTION OF THE DRAWINGS

Reference will now be made to the accompanying drawings in which.

DETAILED DESCRIPTION OF THE PREFERRED EMBODIMENTS

Figure 1:
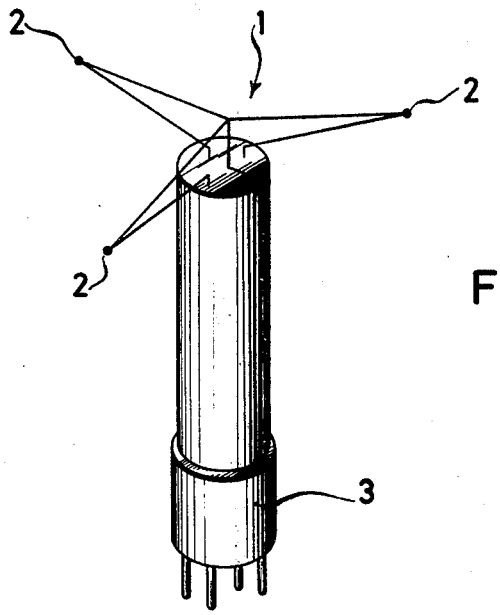
FIG. 1 is a perspective view of a unit for supporting multiple thermosensitive elements constructed in accordance with an exemplary embodiment of the present invention.
Figure 2:
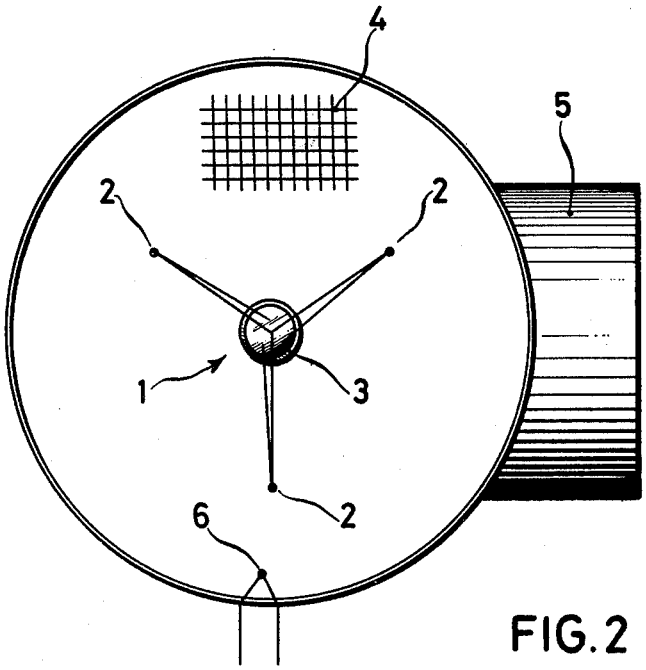
FIG. 2 is a plan view of a gas burner with which the apparatus of FIG. 1 is used.

Referring first to FIG. 1, an arrangement for mounting and locating three thermosensitive elements is illustrated. A four-prong plug 3, which is adapted to be received in a corresponding socket located at the bottom of the mixing chamber of a gas burner, has an upstanding body which supports three thermosensitive elements 2. Each of the elements 2 responds to the temperature at its location by changing its electrical resistance in response thereto, and two lines connect each of the thermosensitive elements 2 to two of the pins of the connector 3. The three thermosensitive elements are connected in star configuration, so that a four-prong plug is adequate to make all of the required connections. The apparatus of FIG. 1 is supported within a gas burner in such a way that the thermosensitive elements 2 lie at points on the underside of the glsss-ceramic heating surface spaced about 120° apart, as shown in FIG. 2. In the apparatus of FIG. 2, the nozzle plate 4 of the burner is illustrated, as well as the exhaust channel 5. An additional thermosensitive element 6 is disposed in the burner chamber at its outer edge, in a position to be acted upon directly by the gas flame. The body that supports the three thermosensitive elements is preferably ceramic.

Figure 3:
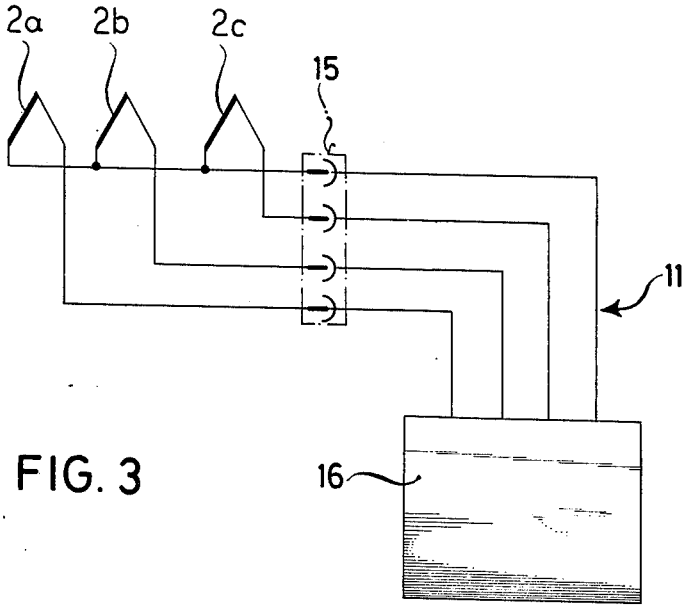
FIG. 3 is a schematic diagram of the apparatus illustrated in FIG. 1, connected to an electronic control system.

In FIG. 3, a connector 15 is illustrated, by which three thermosensitive elements 2*a*, 2*b* and 2*c* may be connected over a four-wire cable 11 to an electronic control system 16. The thermosensitive elements 2*a*, 2*b* and 2*c* of FIG. 3 correspond to the three thermosensitive elements 2 of FIGS. 1 and 2.

Figure 4:
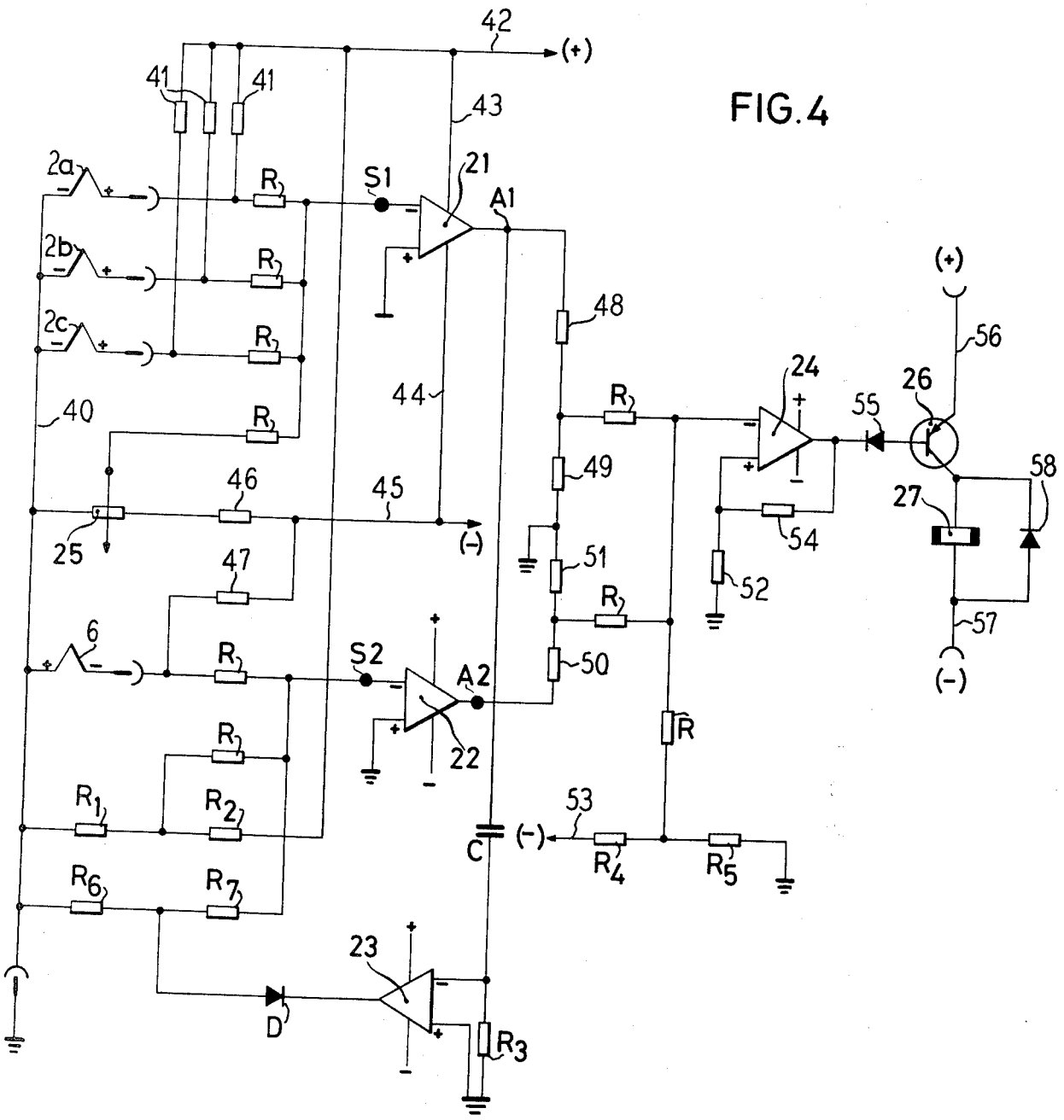
FIG. 4 is a schematic diagram of a control circuit constructed in accordance with one embodiment of the present invention.

Referring now to FIG. 4, three thermosensitive elements 2*a*, 2*b* and 2*c* are connected in star configuration, with the common connected terminal of each being connected to ground by a line 40. The other end of each of the elements 2*a*, 2*b* and 2*c* is connected through an individual resistor 41 to a source of a positive potential at a line 42 and an individual resistor R to a summing point $S_1$, at the inverting input of a comparator 21. The comparator 21 is provided with a connection by a line 43 to the positive source of potential at the line 42, and is also connected by a line 44 to a negative source of potential at a line 45. A potentiometer 25 is connected between the lines 40 and 45, in series with a resistor 46, and its tap is connected through another resistor R to the summing point $S_1$. The potentiometer 25 functions to select the desired average energy output of the gas burner, by controlling the conditions under which the comparator 21 is operated by the thermosensitive devices 2*a*, 2*b* and 2*c*, as explained hereinafter.

A fourth thermosensitive unit 6 has one terminal connected to ground by the line 40, and its other terminal connected through a resistor 47 to the negative potential line 45. The other terminal is also connected through a resistor R to a second summing point $S_2$, at the inverting input of a comparator 22. The comparator 22, like the comparator 21, is connected to sources of positive and negative potential in the conventional manner.

A voltage divider including resistors $R_1$ and $R_2$ is connected in series between the lines 42 and 40, and the junction of the resistors $R_1$ and $R_2$ is connected by means of a resistor R to the summing point $S_2$. The second comparator 22 functions to produce a signal indicative of on-going combustion of gas, so that the supply of gas to the burner may safely be continued. The resistors $R_1$ and $R_2$ supply an appropriate bias to the comparator 22.

A third comparator 23 has its inverting input connected through a capacitior C to the output of the comparator 21, and this input is also connected to ground through a resistor $R_3$. The comparator 23 is connected to positive and negative sources of potential, and its output is connected through a diode D and a resistor $R_6$ to the line 40. The non-inverting inputs of all three of the comparators 21, 22 and 23 are connected to ground. The junction of the diode D and the resistor $R_6$ is connected through a resistor $R_7$ to the summing point $S_2$. The comparator 22 operates, during a brief period while the gas is being ignited, to allow gas to be supplied to the burner for this purpose, overriding the normal operation of the thermosensitive element 6 and its associated circuitry.

The output of the comparator 21 is connected to a voltage divider incorporating resistors 48 and 49, the output of which is connected through a resistor R to the inverting input of a fourth comparator 24. In similar fashion, the output of the comparator 22 is connected o a voltage divider including resistors 50 and 51, the output of which is connected through a resistor R to the same input of the comparator 24. The comparator 24, like the other comparators referred to above, is connected to sources of positive and negative potential. Its non-inverting input is connected to ground through a resistor 52. The comparator 24 functions to produce a signal which causes the gas valve to open or remain open when the conditions are safe, as indicated by the comparator 22, and by the comparator 21.

A voltage divider incorporating resistors $R_4$ and $R_5$ is connected between a source of negative potential on a line 53 and ground, and its output is connected through a resistor R to the inverting input of the comparator 24, to supply an appropriate bias to the comparator 24. A resistor 54 is connected between the output of the comparator 24 and its non-inverting input, the provide some hysteresis in the operation of the comparator 24, and the output of the comparator 24 is also connected through a diode 55 to the base of a pnp transistor 26. The emitter of the transistor 26 is connected to a source of positive potential by a line 56, and its collector is connected through a relay coil 27 to a source of negative potential on a line 57. A diode 58 is connected across the relay coil 27, to short-circuit the relay coil 27 when the transistor 26 is cut off.

In operation, the signals produced by the thermosensitive elements 2*a*, 2*b* and 2*c* are summed at the summing point $S_1$, along with the opposite polarity signal produced by the potentiometer 25. The potentiometer 25 is set in accordance with the desired cooking surface temperature. If the combined potential at the summing point $S_1$ is lower than ground potential, a turn-on signal is produced by the comparator 21. This corresponds to the temperature sensed by the thermosensitive elements *2a, 2b* and *2c* being less than the predetermined value of temperature represented by the setting of the potentiometer 25. When the temperature is greater than the predetermined value, the voltage level at the summing point $S_1$ exceeds ground potential, and a turn-off signal is produced at the output of the comparator 21. The comparator 21, as well as the other comparators illustrated in FIG. 4, is preferably of the saturated type, so that the output voltage assumes one of two values, depending on the condition of the inputs. In a preferred embodiment, the output voltage levels are either +10 volts or −10 volts.

Because of the decoupling resistors R, which are connected in series with each of the thermosensitive elements *2a, 2b* and *2c*, the three elements operate independently of each other. Near the switching threshold, the comparator 21 is essentially controlled by the hottest of the three thermosensitive elements *2a, 2b* and *2c*. In this way, the temperature of the hottest segment of the heated cooking surface (FIG. 2) is limited to a value of temperature which corresponds to the setting of the potentiometer 25. In this way, the arrangment of the present invention insures that no segment of the cooking surface exceeds a predetermined maximum temperature, and the combination of the thermosensitive elements and the comparator 21 controls both a maximum temperature limitation and the average energy output of the burner.

If desired, the summing point $S_1$ can also be connected to a source of a constant voltage which serves as a fixed comparison potential corresponding to a specific temperature value, such as for example, to 20° C. When this arrangement is desired, a suitable voltage divider is connected between the lines 42 and 40, and the output of the voltage divider is then connected to the summing point $S_1$ through a suitable resistor R, to provide a suitable bias to the summing point $S_1$.

Figure 5:
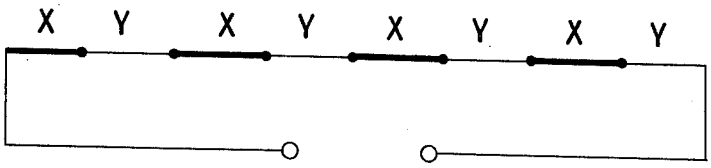
FIG. 5 is an illustration of an alternative arrangement of a thermosensitive element.

It has been found that three thermosensitive elements are usually adequate to carry out the functions of controlling the energy output of the burner and the maximum temperature limitation, for any cooking surface load. The control of the maximum temperature limit is less certain, however, when two of the three thermosensitive elements are severely cooled by a pot which is placed in a particularly unfavorable manner on the heated surface, so that two segments of the heated surface are much less hot than the third. More effective control over the maximum temperature limit during these conditions is achieved when the thermosensitive apparatus illustrated in FIG. 5 is substituted for the thermosensitive elements *2a, 2b* and *2c*. The apparatus of FIG. 5 consists of a series of short segments or pieces X of wire formed by NiCr which are interconnected with segments Y of wire formed of Ni. The ends of the segments are welded to each other, and the series of connected wire segments is arranged circularly on the bottom of the heated surface at the line which is the locus of the hottest zone. When the apparatus of FIG. is employed, it is substituted for the thermosensitive element *2a*, and the elements *2b* and *2c* are omitted together with their associated resistors 41.

In yet another alternative arrangement, four or more thermosensitive elements are employed, each connected in the manner illustrated for the thermosensitive elements *2a, 2b* and *2c* of FIG. 4, and each responsible for monitoring a smaller total area of the heated surface. In this way, additional zones of the heated surface can be monitored. If desired, the provision of different values of summing resistors R, which interconnect each of the thermosensitive elements to the summing point $S_1$, can be chosen, to effect a differential weighting of the signals from the individual thermosensitive elements.

The thermosensitive element 6 is the ignition monitoring element, and is arranged to supply a negative signal to the summing point $S_2$ of the comparator 22. The element 6 is supported so that it is directly in the gas flame. When the flame is on, the element 6 produces a relatively negative potential at the summing point $S_2$, to cause a turn-on signal to be produced at the output of the comparator 22. When the flame is extinguished, the potential at the summing point $S_2$ rises, biased by the voltage divider including the resistors $R_1$ and $R_2$, so that a turn-off signal is produced at the output of the comparator 22. This normally prevents the gas valve from opening when the flame is not present, to avoid an accumulation of unburned gas in the exhaust channel 5. If either of the comparators 21 or 22 produce a turn-off signal, the comparator 24 responds to cut off the transistor 26 and close the gas valve controlled by the relay coil 27.

When the burner is first ignited, it is necessary that the gas valve controlled by the relay coil 27 be briefly opened, even without a flame being present. This purpose is served by a time-delay circuit incorporating the comparator 23, the delay period of which is determined by the series circuit including the condensor C and the resistor $R_3$. When the output of the comparator 21 first goes high, a high signal is supplied to the inverting input of the comparator 23, so that its output goes low, pulling the potential at the summing point $S_2$ low and turning on the comparator 22. If the outputs of both the comparators 21 and 22 are then high, the gas valve controlled by the relay coil 27 is opened, so that in this manner, the gas is admitted to the burner chamber.

When the signal produced by the comparator 21 first goes high, the capacitor C is charged through the resistor $R_3$, but after about 6 seconds, the capacitor C is sufficiently fully charged so that the voltage level at the output of the comparator 23 rises, back-biasing the diode D. This returns control of the comparator 22 to operation of the thermosensitive element 6, so that the relay coil 27 can be deenergized if the flame should be extinguished. When the gas valve is turned off, as a result of a low level turn-off signal being generated by the comparator 21, the capacitor C is discharged to a constant value. Thus, the time constant of about 6 seconds is the same each time the voltage level at the output of the comparator 21 goes high.

In an alternatve embodiment, the output of the comparator 23 may be coupled by way of a summation resistor to a summing input of the comparator 24 at its inverting input, so that the output of the comparator 23 controls operation of the comparator 24 directly. In this arrangement, the comparator 22 functions only for monitoring the flame after ignition. In this arrangement, the positions of the capacitor C and resistor $R_3$ are interchanged, so that a high signal at the output of the comparator 23 persists for only about 6 seconds following a turn-on signal from the comparator 21, after which the charge level on the capacitor is sufficient to operate the comparator 23, which then produces a low level signal at its output. The relative sizes of the coupling resistors connected to the inverting input of the comparator 24 are chosen so that, for the comparator 24 to produce a low level output, to open the gas valve, the output of the comparator 21 must be high, as well as the outputs of at least one of the comparators 22 and 23. If neither of the comparators 22 and 23 produces a high level output, or the comparator 21 does not produce a high level output (irrespective of the comparators 22 and 23) the gas valve is closed.

In yet another alternative arrangement, where ambient temperatures permit, a photoresistor or a photoelectric cell can be employed as a sensing element for monitoring the flame in place of the thermosensitive element 6. Ionisation sensors may also be used, if wanted.

The resistors 41 of FIG. 4 function to supply relatively high voltage to the summing point $S_1$ if any of the thermosensitive elements *2a, 2b* and *2c* should fail and become open-circuited. This causes the comparator 21 to produce a turn-off signal, which prevents operation of the relay coil 27 when any of the thermosensitive elements *2a, 2b* and *2c* are not operative. In similar fashion, if the thermosensitive element 6 should become open-circuited, the potential at the summing point $S_2$ is relatively high, turning off the comparator 22. This provides for fail-safe operation.

The comparator 24 functions to allow the transistor 26 to conduct only when both of the comparators 21 and 22 produce a high output signal. The voltage divider including the resistors $R_4$ and $R_5$ supply a low-value bias to the inverting input of the comparator 24, such that in the embodiment shown in FIG. 4 both of the outputs of the comparator 21 and 22 at the points A1 and A2 must be high in order to cause the potential at the inverting input of the comparator 24 to exceed the potential at its non-inverting input. When this occurs, the output of the comparator 24 goes low, and base current is drawn through the diode 55 allowing the transistor 26 to conduct and to operate the relay coil 27. The resistor 54 is provided to establish a small amount of hysteresis in the operation of the comparator 24 to improve its immunity to noise.

Figure 6:
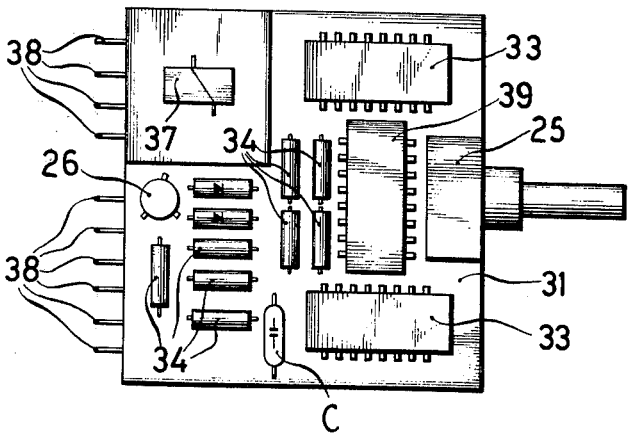
FIG. 6 is an illustration of a circuit board constructed in accordance with an embodiment of the present invention.

FIG. 6 illustrates a physical embodiment of the arrangement illustrated in FIG. 4. Preferably, the four comparators of FIG. 4 are incorporated in a single integrated circuit chip 39 which takes the form of a conventional 16-pin dual in-line package. Since most of the resistors of FIG. 4 are of equal value, as indicated by the reference R, it is expedient to use dual in-line packages for these resistors. Two such packages 33 are illustrated in FIG. 6. The circuit board 31 supports the IC packages 33 and 39, and also provides circuit connections by which the pins of the IC packages may be connected together, in conventional fashion. The circuit board 31 also supports the potentiometer 25. Resistors 34 are illustrated in FIG. 6 corresponding to the resistors of FIG. 4 which are not of equal value, and the capacitor C, the transistor 26, and a relay 37 are also supported by the board 31. Connection pins 38 facilitate electrical interconnection of the circuit board of FIG. 6 to the thermosensitive elements 2 and 6, and to appropriate voltage sources. The relay 37 of which the coil 27 is shown in FIG. 4, preferably controls a solenoid-operated gas valve in the gas supply line to the burner. Alternatively, the solenoid valve may be controlled directly by the transistor 26 instead of using an intermediate relay 37.

The circuit board 31 of FIG. 6 has dimensions of 55mm × 55mm, so that all of the apparatus required for the control and monitoring functions occupy only a very small space. Preferably, a protective housing is provided for surrounding the circuit board 31 and its components, and its dimensions may be as small as 60 × 60 × 50mm. Preferably, a single power supply unit is provided to supply the operating potentials required for the apparatus, in which operating voltages are stabilized by the use of zener diodes in conventional fashion.

Although the present invention has been described especially in connection with radiant gas heated cooking surfaces made of glass-ceramic materials, the present invention may also be employed in connection with other gas or oil burners with a corresponding arrangement of the thermosensitive elements. The apparatus of the present invention may also be employed for controlling conventional electric ranges, and in this case, the ignition safety circuitry and the flame monitoring thermosensitive element may be omitted.

The thermosensitive elements 2 and 6 have been described as responding to temperature changes by changing their resistance. In the alternative, temperature sensitive voltaic sources may be employed if desired.

Where the thermosensitive elements 2 comprise junctions of dissimilar metals, the two metals are preferably welded together to form the junctions.

It will be apparent that various additional modifications and additions may be made in the apparatus disclosed herein, without departing from the essential features of novelty thereof, which are intended to be defined and secured by the appended claims.

What is claimed is:

1. A control and monitoring systems for a burner, for monitoring fuel ignition and combustion, controlling the average energy output of the burner, and establishing a maximum temperature limit, comprising an electronic circuit having four comparators, a first thermosensitive element connected to a first of said comparators, said first comparator being responsive to said first thermosensitive element to produce a first signal for controlling the average energy output of said burner and for establishing a maximum temperature limit, a second thermosensitive element connected to a second comparator, said second comparator being responsive to said second thermosensitive element to produce a second signal in response to the presence of a flame in the burner, a third comparator being connected with said first comparator for establishing a time interval during ignition of said flame during which a signal produced by said second thermosensitive element is non-functional, and means connecting said first and second signals to a fourth comparator, said fourth comparator being responsive thereto to produce a third signal only when said first and second signals are in a predetermined condition, and means connected with said fourth comparator for receiving said third signal and operating in resonse thereto to control the fuel supply to said burner.

2. Apparatus according to claim 1, wherein said first thermosensitive element is placed at a point of heating concentration within said burner.

3. Apparatus according to claim 1, wherein said first thermosensitive element comprises a group of three two-terminal thermosensitive elements, means for connecting said three thermosensitive elements in a star configuration with one terminal of each element connected in common, and a four-pin plug for supporting said star configuration in operative relation with said burner.

4. Apparatus according to claim 3, wherein said individual thermosensitive elements are positioned in equally spaced relationship in the hottest zone of said burner.

5. Apparatus according to claim 1, wherein said first thermosensitive element comprises a series connection of a plurality of separate thermosensitive elements, comprising dissimilar metals interconnected with each other in alternating arrangement, and supported in a circular shape juxtaposed with the hottest zone of said burner.

6. Apparatus according to claim 5, wherein said thermosensitve elements consist of alternating segments of nickel and nickel chromium wire.

7. Apparatus according to claim 1, wherein said second thermosensitive element is placed directly in the flame of said burner.

8. Apparatus according to claim 1, wherein said second thermosensitve elements comprises a photoresistor or a photoelectric cell.

9. Apparatus according to claim 1, including an RC circuit interconnected between the output of said first comparator and the input of said third comparator so that said third comparator is operated briefly concurrently with each operation of said first comparator.

10. Apparatus according to claim 9, wherein said third comparator is momentarily turned on by said first comparator at the moment of ignition.

11. Apparatus according to claim 9, wherein said third comparator momentarily switches on said fourth comparator.

12. Apparatus according to claim 1, wherein all of said four comparators are identical and are contained in a single integrated circuit chip.

13. A control and monitoring system for a burner having a heated surface, comprising a first thermosensitive element for producing an electrical signal responsive to the hottest portion of said surface, first means connected to said first thermosensitve element and connected to an adjustable electrical source for producing a first output signal when the signal produced by said adjustable source is representative of a lower temperature than the temperature of said thermosensitive element, a second thermosensitive element responsive to the presence of a flame within said burner and second means connected thereto for producing a second output signal when said flame is present, third means for producing a third output signal concurrently with the initiation of said first output signal, fourth means connected to receive said first output signal and responsive thereto when either of said second and third output signals coincide therewith to introduce fuel into said burner.

14. Apparatus according to claim 13, wherein said first, second, third and fourth means all comprise identical comparators.

15. Apparatus according to claim 13, including means connected with said first means for inhibiting production of said first signal in the event that said first thermosensitive element becomes open-circuited.

16. Apparatus according to claim 13, including means connected with said second means for inhibiting said second signal in the event that said second thermosensitive element becomes open-circuited.

* * * * *